United States Patent [19]

Zagoroff

[11] Patent Number: 4,538,363

[45] Date of Patent: Sep. 3, 1985

[54] SHRINK OVEN

[76] Inventor: Dimiter S. Zagoroff, 10 Hilliard Pl., Cambridge, Mass. 02138

[21] Appl. No.: 608,431

[22] Filed: May 9, 1984

Related U.S. Application Data

[63] Continuation-in-part of Ser. No. 575,888, Feb. 1, 1984.

[51] Int. Cl.[3] ..... F26B 15/16

[52] U.S. Cl. ..... 34/225; 34/233; 34/242; 53/442; 53/557

[58] Field of Search ..... 34/225, 233, 12, 33, 34/242; 53/442, 557

[56] References Cited

U.S. PATENT DOCUMENTS 3,399,506 9/1968 Howe, Jr. ..... 53/442

3,807,126 4/1974 Schwarz ..... 53/442

*Primary Examiner*—Larry I. Schwartz

[57] ABSTRACT

A shrink oven whose air volume is maintained constant as heated loads are removed and new loads are introduced, to prevent loss of heat and to improve performance. In an oven in which loads are introduced through an entry opening, move through the oven, and exit through another opening, exiting and entering loads are moved so that the rate of load displacement out of the oven at the exit is compensated by the rate of load displacement into the oven at the entry. Special arrangements prevent hot air loss around the sides of the load during the exit and introduction phases. These include close-lying passage walls above and on both sides of the openings, for limiting the air conductance of the gaps about the loads, stacking adjacent loads close together at entry and exit to minimize air leak gaps between the loads, and close positioning of the loads next to doors during opening and closing of doors.

7 Claims, 3 Drawing Figures

SHRINK OVEN

This application is a continuation-in-part of my application U.S. Ser. No. 575,888 filed Feb. 1, 1984.

BACKGROUND OF THE INVENTION

This invention is in the field of ovens used for shrink wrapping. A common application of this technique utilizes pre-formed polyethylene bags with a film thickness in the range of 0.002 to 0.012 inch that are put over goods stacked on a pallet. The pallet is then placed in the oven to heat the polyethylene to its shrink temperature in the range of 190 degrees to 300 degrees Fahrenheit. At this temperature the bag shrinks, conforming to the shape of the load and setting up a shrink tension that locks the load securely to itself and to the pallet.

PRIOR ART

A common shrink-oven configuration has side-mounted doors, either on one side only for applications where the pallet enters and exits through the same door, or two sets of doors on opposite sides for a through-flow pallet travel. The most common heating means is by convection. Hot air with a working temperature of 300 to 1000 degrees Fahrenheit is circulated to achieve the desired heat transfer.

One drawback of this arrangement is that when the doors are opened nearly all of the heated air inside the oven spills and is lost to the surroundings. In each cycle the oven thus has to heat not only the film to its shrink temperature but also nearly the whole interior volume of air to its considerably higher working temperature.

To minimize this escape of hot air, other prior art ovens have been fashioned in the form of a heat-bell positioned over the pallet with a bottom-mounted door. In operation, once the oven door is opened, the pallet is either brought up into the oven or the whole oven is lowered over the pallet.

This arrangement does reduce the amount of hot air lost to the surroundings since the hot air remains trapped by its own buoyancy even when the doors are open, but since each entering load displaces air from the oven, there is still a considerable loss of heated air and the additional height and mode of operation of this arrangement are often objectionable.

The direct heat lost by the displacement of a load is considerable. For example, for a common pallet load measuring 40×48 inches×72 inches high covered by a 0.005 inch thick bag, the heat lost in the air equals the heat transferred into the film if the air has a working temperature of 300 degrees Fahrenheit and can be more than three times as much if the air has a working temperature of 1000 degrees Fahrenheit.

In addition to the direct heat losses, there are indirect losses attributable, e.g. to (a) the higher heating temperature required to compensate for the influx of cold air and (b) the heat losses incurred during the time while the cold air is heated.

The total loss in thermal efficiency is thus greater by a considerable factor than the direct heat loss and becomes even less favorable when the new high-strength, thin films are considered.

Furthermore, the additional heating required has an adverse effect upon cycle time, power rating and utilization of capital equipment and space.

The objects of this invention are to greatly reduce the heat losses mentioned, to decrease cycle time, to decrease the connected or peak heat rating and to achieve greater economy and ease of operation of shrink ovens when all costs and factors of convenience and efficiency are taken into account.

SUMMARY OF THE INVENTION

The present invention provides synchronized means during exit and entry of loads to keep the air volume of the oven constant. The unwanted escape of hot air is prevented as the load is removed or introduced by synchronizing the movement of an exiting pallet load with one that enters so that there is no net change in the air volume of the oven. With greater particularity, the invention features a shrink oven for heating and shrinking plastic film disposed about loads, preferably loads on pallets covered by shrinkable plastic film, and a method for its use, the oven having an opening for exit of a first load, the oven characterized in having movable means to move a second load through an entry opening into the oven and synchronizing means for causing the movable means to move in a manner dependently with exit movement of the first load, to displace heated oven air to fill the air space left behind the first load as it exits the oven, thereby to limit inward flow of cool air during exit of the load whereby conservation of energy and improvement in the shrink cycle can be obtained.

In preferred embodiments the entry and exit openings are associated with means limiting air flow past the sides of the entering and exiting loads.

In certain preferred embodiments means are provided to stack an entering or exiting load closely adjacent to another load to limit flow of heated air at the outer end of the load as it enters or exits the oven; means are provided to maintain spacing of a load from the adjacent loads wile the load is resident in the oven to expose the end of the load to heat; there are first and second load conveyors at the entrance and exit openings, respectively, of the oven, operable at the same speed for supplying a fresh load while a heated load is removed, and means are provided within the oven operable to remove a load from the first conveyor, position the load for exposure of its ends to heat and deliver the heated load to the second conveyor, this means preferably comprising a further conveyor driven dependently with, and at a faster speed than, the first and second conveyors, the conveyors adapted to stop in unison while a load is on the further conveyor in the oven and spaced from adjacent loads.

The invention features the related method of heating and shrinking plastic film disposed about loads employing an oven having entry and exit openings through which loads simultaneously are moved, comprising closely stacking adjacent loads together at the entry or exit opening to prevent loss of heated air at the opening, and maintaining a load separate from the adjacent load while in the oven to expose the corresponding end of the load to heat.

In other preferred embodiments, the shrink oven has a door closure for the opening and there is a means responsive to the position of the load in close proximity to the oven door to open and close it; the entry and exit openings are on opposite sides of the oven, the openings being associated with means limiting air flow past the sides of the entering and exiting loads; control means are adapted to ensure close proximity of loads to doors at the openings whenever the doors are open to limit movement of air through the opening when the doors are open; a conveyor means extends through the oven and means are provided to establish spacing of the loads thereon at a distance corresponding to the distance between the openings; and shrouds are provided on both sides of the entry and exit to limit the air conductance at the top and sides of the loads while the loads reside in an air blocking relationship at the oven openings.

The invention also features the related method of heating and shrinking plastic film disposed about loads employing an oven having two doors, comprising positioning a completed load in the oven closely adjacent to one door and a load to be heated closely adjacent the other door, and thereupon opening the doors while the loads remain in the positions blocking movement of air through the openings, moving the loads simultaneously out and in, respectively, stopping the loads immediately beyond the doors, and while the loads remain in the position in which they block air flow, closing the doors.

DRAWINGS

FIG. 3 is the same view as FIG. 2 showing the first load leaving the oven while the second load is entering.

STRUCTURE, FIG. 1

Figure 1:
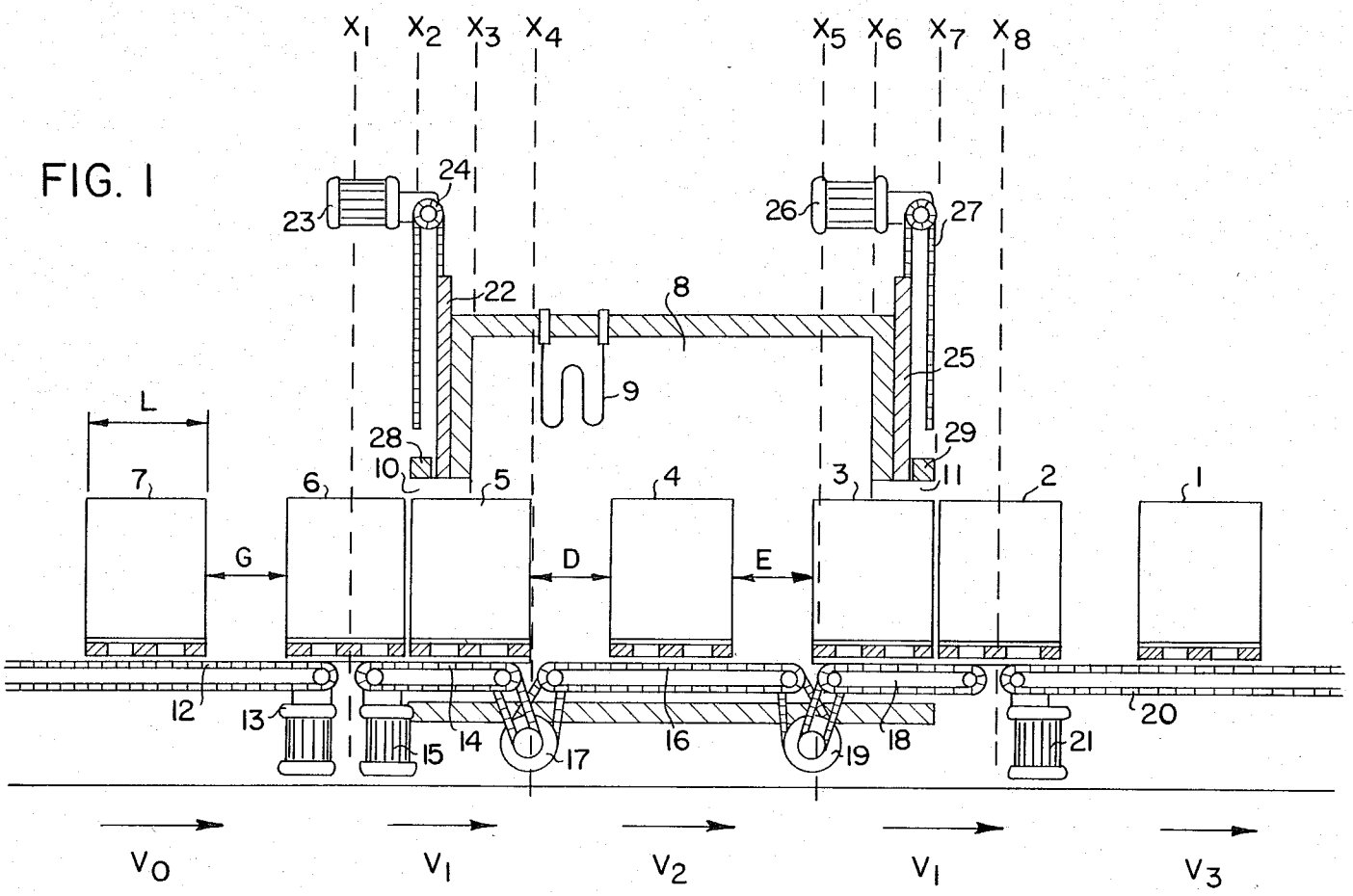
FIG. 1 is a front view partially in section of an embodiment which employs close-together pallet loads themselves as the means for preventing loss of heated air.

Referring to FIG. 1, successive pallet loads 1, 2, 3, 4, 5, 6, and 7 enter oven 8 through antechamber 28 which is sized to accommodate the moving load in a tight fit. Incoming load 7 arrives on conveyor 12 driven by motor 13 at speed $v_0$. Before it enters the oven at 10 it is transferred onto conveyor 14 driven by motor 15 at speed $v_1$ which is sufficiently smaller than $v_0$ so that the gap g between successive loads is eliminated (to prevent loss of heated air as described more fully below) before they enter the entrance of antechamber 28. Inside the oven the loads are transferred onto conveyor 16 driven by chain-drive transmission 17 at speed $v_2$. Speed $v_2$ is greater than $v_1$. As a result, a widening gap d is created between load 4 on conveyor 16 and load 5 on conveyor 14 to enable exposure of the sides of the load to heated air. Before the load exits the oven, it is transferred onto conveyor 18 driven by chain-drive transmission 19 at speed $v_1$. Since $v_1$ is smaller than $v_2$, the gap e between load 3 on conveyor 18 and load 4 on conveyor 16 decreases progressively. The velocity ratio $v_1/v_2$ is chosen such that for a given length of conveyor 16 and a given load length l, gap e is reduced to zero before load 4 enters exit chamber 11. Chamber 11 is sized to accommodate the load in a tight fit. Outside the oven, load 2 is transferred onto conveyor 20 driven by motor 21. Conveyor 20 may be driven at any speed, $v_3$, suitable for subsequent handling. Antechamber 28 and exit chamber 29 provide extended walls at the top and sides of the load, in the direction of travel of the conveyors. These walls are closely opposed to corresponding surfaces of the pallet load and thus serve as shrouds to limit the air conductance at the gaps about the load.

Entry door 22 is opened and closed when desired by motor 23 via chain hoist 24 and exit door 25 is similarly opened and closed by motor 26 via chain hoist 27.

OPERATION

Incoming load 7 covered by a heat shrinkable bag (not shown) is slowed down by conveyor 14 so that successive loads 5 and 6 enter oven 8 in a stacked (laterally crowded-together) condition without an air gap between them. Coupled conveyor 18 removes outgoing loads 2 and 3 also in a stack without an air gap between them at the same speed. Inside the oven, conveyor 16 which is coupled to run at a speed greater than conveyors 14 and 18, receives a pallet from the incoming stack and speeds it on to join the outgoing stack. In this transfer, both front and back faces of the load become exposed and can be heated to shrink temperature either while load 4 is in motion, or by stopping conveyors 14, 16 and 18 when load 4 is in the center for a predetermined time necessary to heat the shrink film to the temperature at which it will shrink. The heater is shown diagrammatically as a resistance element 9; it is preferred also to employ a blower which propels heated air through a series of impingement jets that are strategically located and directed to assure the quick and complete shrinkage of the film.

In continuous operation, both entry door 22 and exit door 25 remain fixed in the open position. They are needed only (to retain heat) before start-up and after shut-down, or when the stream of loads is interrupted.

The close spacing between incoming loads minimizes transport of cold air into the oven, and conversely, the close spacing between the outgoing loads minimizes transport of hot air out of the oven. The equal speeds of the entering stack and outgoing stack of loads means that there is no net displacement of oven air volume. Due to the tight fit between the surfaces of the loads and the extended walls of the chambers 28 and 29, a labyrinth air-seal effect is provided and escape of hot air past the gaps is minimized.

To achieve the stacking of the loads before entry and before exit such that there is no displacement of oven air, certain relationships should be observed in the construction. Let:

$X_1$ be the location of the changeover from conveyor 12 to 14, $X_2$ be the location of the entry of antechamber 28, $X_3$ be the location of interior edge of door opening 10, $X_4$ be the location of changeover from conveyor 14 to 16, $X_5$ be the location of changeover from conveyor 16 to 18, $X_6$ be the location of interior edge of door opening 11, $X_7$ be the location of exit out of antechamber 29, $X_8$ be the location of changeover from conveyor 18 to 20, then:

distance $X_1$–$X_2$ should be greater than $\frac{1}{2}$ length of load, distance $X_3$–$X_4$ should be greater than $\frac{1}{2}$ length of load, distance $X_5$–$X_6$ should be greater than $\frac{1}{2}$ length of load, distance $X_7$–$X_8$ should be greater than $\frac{1}{2}$ length of load.

To assure assure that the gap e is closed:

distance $(X_4-X_5)\times v_2=\text{length of load}\times v_1$.

STRUCTURE, FIGS. 2-3

Figure 2:
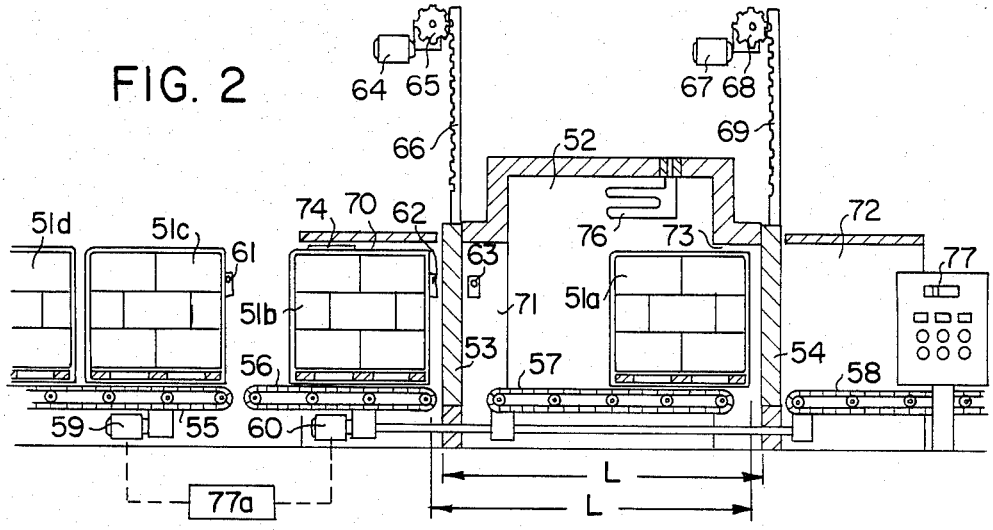
FIGS. 2 and 3 are similar to FIG. 1 of another embodiment, FIG. 2 showing one load within the oven while an other load is ready to be charged
Figure 3:
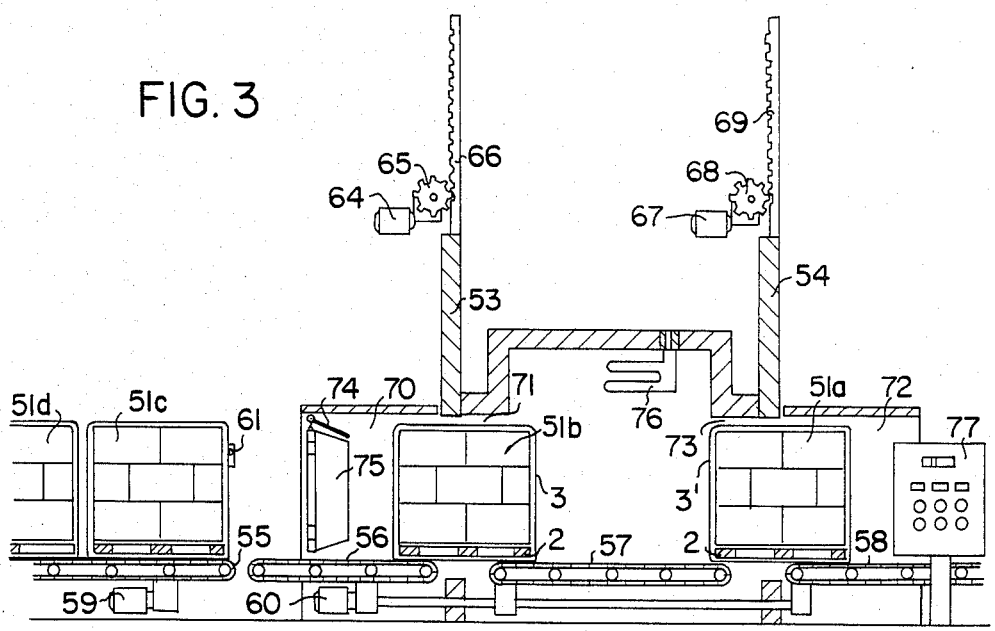

Referring now to the embodiment of FIGS. 2 and 3, successive pallet loads 51*a*, 51*b* and 51*c* enter oven 52 through incoming door 53 and exit the oven through outgoing door 54. Two conveyor systems consisting of conveyor 55 and coupled conveyors 56, 57, and 58 are driven by motors 59 and 60 respectively in such a manner that incoming pallets are first brought to a halt at the end of conveyor 55 and then picked up by conveyor 56 to achieve an even spacing L between the front faces of successive pallet loads that corresponds exactly to the spacing between oven doors 53 and 54. Electric eyes 61, 62 and 63 are located at the end of conveyor 55, ahead of the door 53 and behind the door 53 respectively. Sliding doors 53 and 54 are opened and closed in unison by motors 64 and 67 driving pinion and rack sets 65, 66 and 68, 69, respectively. Antechamber 70 is located ahead of the incoming door 53 and is sized to accommodate the largest pallet load in a tight fit in height and width, thus to serve as a shroud to limit the air conductance at the gaps about the load. Another chamber 71 of similar dimensions is situated between the door and the oven interior. Corresponding chambers 72 and 73 are situated at the exit end. Spring-loaded, hinged top flap 74 and side flaps 75 (one shown) are located inside chamber 70 to take up the gap between the pallet load and the chamber walls for smaller loads. A suitable heating system is provided, schematically denoted by heating element 76. Controller 77 is adapted to be preprogrammed to regulate the temperature inside the oven and to actuate all motors in sequence and can be set to vary their speed and dwell time.

OPERATION

Pallet load 51*b* stacked on a pallet 2 and covered by loosely fitting heat shrinkable bag 3 is transported by conveyor 56 through the antechamber 70, pushing past the spring-loaded flaps 74, 75. Coupled conveyor 57 simultaneously transports pallet load 51*a* stacked on pallet 2 and covered tightly by heat shrink bag 3' from the center of the oven through chamber 73. When the front faces of the two pallets (which are spaced a distance L apart that corresponds exactly to the spacing between the two doors) are in close proximity to the oven doors 53 and 54 respectively, electric eye 62, detecting the front face of pallet load 51*b*, signals the controller to stop the conveyor motor 60, open the doors (with motors 64 and 67 driving pinions 65 and 68 and racks 66 and 69) to a height preset in relation to the height of the loads. As a result of the tight fit between the sides of the loads and the walls of chambers 71 and 73 as well as the close proximity between the loads and the door openings, the loads block the escape of heat from the oven as the doors are being opened.

Once the doors are open the controller starts conveyors 56, 57 and 58 to transport load 51*a* out and load 51*b* into the oven. The controller also starts conveyor 55 during this phase to place load 51*c* onto conveyor 56 at the right time to achieve the correct spacing. As soon as electric eye 61 detects the face of load 51*d* following load 51*c* arriving in position, it signals the controller to stop conveyor 55. By virtue of the synchronized entry and exit of the two loads the rate of displacement of oven air volume by the entering load equals the rate of oven volume being left vacant by the leaving load, thus keeping the hot air volume of the oven constant. When electric eye 63 senses that load 51*b* is completely inside (indicating also that load 51*a* is completely outside) the oven, it signals the controller to stop conveyors 56, 57 and 58 and close the doors. Again, due to the restricted gaps between the walls of the loads and the walls of extended chambers 71 and 73, which provide a labyrinth air-seal effect, as well as due to the close proximity of the faces of the loads to the doors, escape of hot air from the oven is minimized while the doors are being closed.

As soon as the doors are closed, conveyor 57 moves load 51*b* to the center of the oven to initiate the heating cycle. The load remains in the center of the oven for the predetermined period of time necessary to heat the bag 3 on load 51*b* to the temperature at which it will shrink, the load is moved out and the cycle is ready to be repeated with another load.

There are a number of ways by which spacing L between successive pallet loads may be achieved. In the arrangement shown in FIGS. 2 and 3, conveyor 55 is started to advance pallet 51*c* at the time the front face of pallet load 51*b* reaches distance L from the front face of pallet load 51*c* as determined by counter and control circuit 77*a*. If on the other hand, the distance between electric eyes 61 and 62 is made equal to distance L, then arrival of pallet at eye 62 can "lock" the drive motors 59 and 60 together, for mutual motion until pallet load 51*c* is transferred from conveyor 55 to conveyor 56. In still another arrangement, the conveyors 56 and 57 can be independently driven, but arrival of respective loads at the stop positions at the two doors (e.g. as detected by electric eyes) can, through the action of the controller 77, interlock the conveyors to advance in unison by one pallet width, again causing one load to enter the oven simultaneously with exit of the preceding load.

The embodiment of FIGS. 2 and 3 is useful in cases where it is impractical to provide stacks of identically dimensional pallet loads close together.

One drawback of this second embodiment is that the load has to stop five times (twice in entering, once to shrink and twice in exit) and that the doors have to open and close with each cycle. The attendant loss of time and added wear of the conveyor and door mechanisms may in some cases be objectionable, for instance, in shrink wrapping small objects where high production rates and short cycle times are important.

The embodiment of FIG. 1 retains the advantage of reduced losses of the embodiment of FIGS. 2 and 3 but further decreases the cycle time and achieves maintenance-free high-speed operation.

The invention is useful with radiation as well as convection ovens, and its manner of specific implementation can vary, e.g. in the case of retrofit applications. It should be noted that existing through-flow ovens can be readily modified to practice the invention.

I claim:

1. A shrink oven for heating and shrinking plastic film disposed about loads, said oven having an exit opening for exit of a first load, said oven characterized in having movable means to move a second load through an entry opening into said oven, synchronizing means for causing said movable means to move in a manner dependently with exit movement of said first load to displace heated oven air to fill the air space left behind said first load as it exits the oven, thereby to limit inward flow of cool air during exit of the load, means to stack an entering or exiting load closely adjacent to another load to limit flow of heated air at the outer end of said load as it enters or exits said oven, and means to maintain spacing of a load from adjacent loads while said load is resident in said oven to expose the end of said load to heat, there being first and second conveyors at the entrance and exit openings, respectively, of said oven, operable at the same speed for supplying a fresh load while a heated load is removed, and a further conveyor within said oven operable to remove a load from said first conveyor, position said load for exposure of its ends to heat and deliver the heated load to said second conveyor, said further conveyor driven dependently with, and at a faster speed than, said first and second conveyors, said conveyors adapted to stop in unison while a load is on said further conveyor in said oven and spaced from adjacent loads, whereby conservation of energy and improvement in the shrink cycle can be obtained.

2. The shrink oven of claim 1 further characterized by being sized and adapted to receive loads on pallets covered by shrinkable plastic film.

3. The shrink oven of claim 1 in which said entry and exit openings are associated with means limiting air flow past the sides of said entering and exiting loads.

4. The shrink oven of claim 1 further characterized in having doors for said openings, conveyor means extending through said oven and means to establish spacing of said loads thereon at a distance corresponding to the distance between said openings, and a means responsive to the position of said loads in close proximity to said oven doors to open and close said doors.

5. The shrink oven of claim 4, further including shroud means both inside and outside of said oven at each of said openings, adapted to limit the flow of air past said load when said doors are open.

6. The shrink oven of claim 1 in which there is a door for a said opening and positioning means to assure close positioning of a load at said opening whenever said door is open.

7. The shrink oven of claim 6 wherein said load in its movements relative to said opening is at one time at one side and at another time at the other side of said door when said door is open, and said positioning means are arranged to maintain said load in a close position to the door on each side of the door.

* * * * *